US008025547B2

(12) United States Patent
Chan

(10) Patent No.: US 8,025,547 B2
(45) Date of Patent: Sep. 27, 2011

(54) SYSTEM AND METHOD FOR PROVIDING A TEARING AND WETTING EFFECT IN TOYS

(75) Inventor: Danny Chung Nin Chan, Kowloon (HK)

(73) Assignee: Lotus Onda Industrial Co., Ltd., Hong Kong (HK)

( * ) Notice: Subject to any disclaimer, the term of this patent is extended or adjusted under 35 U.S.C. 154(b) by 181 days.

(21) Appl. No.: 12/504,363

(22) Filed: Jul. 16, 2009

(65) Prior Publication Data

US 2011/0014846 A1 Jan. 20, 2011

(51) Int. Cl.
*A63H 33/40* (2006.01)
*A63H 33/00* (2006.01)

(52) U.S. Cl. ..... 446/180; 446/305; 446/391

(58) Field of Classification Search ..... 446/176–199, 446/301–306, 391, 392
See application file for complete search history.

(56) References Cited

U.S. PATENT DOCUMENTS

| | | | | |
|---|---|---|---|---|
| 5,083,965 | A * | 1/1992 | Mayem | 446/305 |
| 5,094,644 | A * | 3/1992 | Kelley | 446/305 |
| 5,190,492 | A * | 3/1993 | Berenguer | 446/301 |
| 6,790,121 | B2 * | 9/2004 | Llorens | 446/305 |
| 7,189,137 | B2 * | 3/2007 | Ellman et al. | 446/304 |
| 7,247,079 | B2 * | 7/2007 | Maar | 446/306 |

* cited by examiner

*Primary Examiner* — Kien Nguyen
(74) *Attorney, Agent, or Firm* — Tutunjian & Bitetto, P.C.

(57) ABSTRACT

A toy doll system is provided including a self-pressurized fluid receptacle disposed within the doll having a first outlet valve and a second outlet valve operably connected to the receptacle. The receptacle includes a rigid housing member having an interior and a rigid housing cover including a plurality of apertures, wherein a resilient sheet-like member is disposed between the housing member and the housing cover for providing an airtight chamber for storing fluid under pressure between the resilient member and the housing cover. The doll includes first and second activators for manually opening first and second outlet valves, respectively, for providing tearing and wetting effects. A bottle is provided having a tip configured to be insertable into the doll's mouth opening for injecting fluid therein. As fluid is input between the resilient member and the housing cover, the resilient member stretches and expands into the housing member interior accordingly.

20 Claims, 9 Drawing Sheets

SYSTEM AND METHOD FOR PROVIDING A TEARING AND WETTING EFFECT IN TOYS

BACKGROUND OF THE INVENTION

1. Technical Field of the Invention

The present invention relates generally to fluid intake and expulsion systems, and in particular, to a system for providing a tearing and wetting effect in toys such as toy dolls and a method for operating same.

2. Description of Related Art

In the art, toy dolls in a variety of styles, shapes, features and characteristics are known. In particular, dolls which exhibit realistic action features such as 'crying' or 'wetting' diapers are known in the art. Such dolls are desirable and appealing because they emulate habits and actions that occur in real-life babies.

Many such dolls typically involve the use of electronic motors to provide the desired crying or wetting effects, whereupon the particular action is performed upon activation of a switch, to cause, e.g., a pumping effect of the liquid to the desired part of the doll. Typically, in such dolls, motors are battery-powered.

However, a toy including electronic parts often has limited entertainment value, since the desired action functions require power to operate effectively. A child's interest often quickly disappears with such toys once the batteries are depleted.

Furthermore, the addition of electronic parts complicates its design, and thus can lead to increased incidents of malfunction. Such problems can be compounded when involving a device which contains and emits fluids.

Accordingly, a toy doll which effectively provides fluid-emitting functions to emulate such actions as 'tearing' and 'diaper wetting' in a manner which is simple to operate, durable and encourages continued play without reliance on a power source, is highly desirable.

SUMMARY OF THE INVENTION

According to one embodiment, the present invention is directed to a manually operated toy doll for performing 'tearing' and 'wetting' effects upon user-activation of separate controls.

For example, the doll includes at least one inlet disposed thereon for enabling fluid intake, and at least two outlets for emitting fluid, preferably at various locations in the doll, such as the eyes and diaper area. Accordingly to alternate embodiments, a toy may be provided incorporating at least one of a tearing or wetting effect system.

According to an aspect of the present invention, a fluid intake and expulsion system for a toy doll is provided comprising a self-pressurized fluid receptacle, an inlet valve, a first outlet valve and a second outlet valve operably connected to the receptacle, a first valve activator for manually opening the first outlet valve, and a second valve activator configured for manually opening the second outlet valve.

According to another aspect of the present invention, a toy doll is provided comprising a self-pressurized fluid receptacle disposed within the doll having a first outlet valve and a second outlet valve operably connected to the receptacle, wherein the receptacle comprises a rigid housing member having an interior and a rigid housing cover including a plurality of apertures, and a resilient member disposed between the housing member and the housing cover for providing an airtight chamber for storing fluid under pressure between the resilient member and the housing cover. An inlet valve is provided at a mouth opening in the doll and operably connected to the receptacle. A first valve activator button is provided for manually opening the first outlet valve, a second valve activator button is provided configured for manually opening the second outlet valve, and a bottle is provided having a tip configured to be insertable into the mouth opening for opening the inlet valve.

According to yet another aspect of the present invention, a method for providing a tearing and wetting effect in a toy doll is provided comprising the steps of providing fluid into a self-pressurized receptacle inside the doll, providing overflow fluid to flow to a wetting effect valve, determining if at least one of a tearing effect and a wetting effect is desired, and activating a least one of a tearing activator or a wetting activator on the doll.

According to yet another aspect of the present invention, a fluid intake and expulsion system for a toy doll is provided comprising a self-pressurized fluid receptacle, an inlet valve, and at least one of a tears effect valve and a wetting effect valve operably connected to the receptacle, and at least one of a tears valve activator for manually opening the tears effect valve and a wetting activator configured for manually opening the wetting effect valve.

These and other aspects, features, and advantages of the present invention will be described or become apparent from the following detailed description of the preferred embodiments, which is to be read in connection with the accompanying drawings.

BRIEF DESCRIPTION OF THE DRAWINGS

This disclosure will present in detail the following description of preferred embodiments with reference to the following figures wherein.

DETAILED DESCRIPTION OF PREFERRED EMBODIMENTS

Figure 1A:
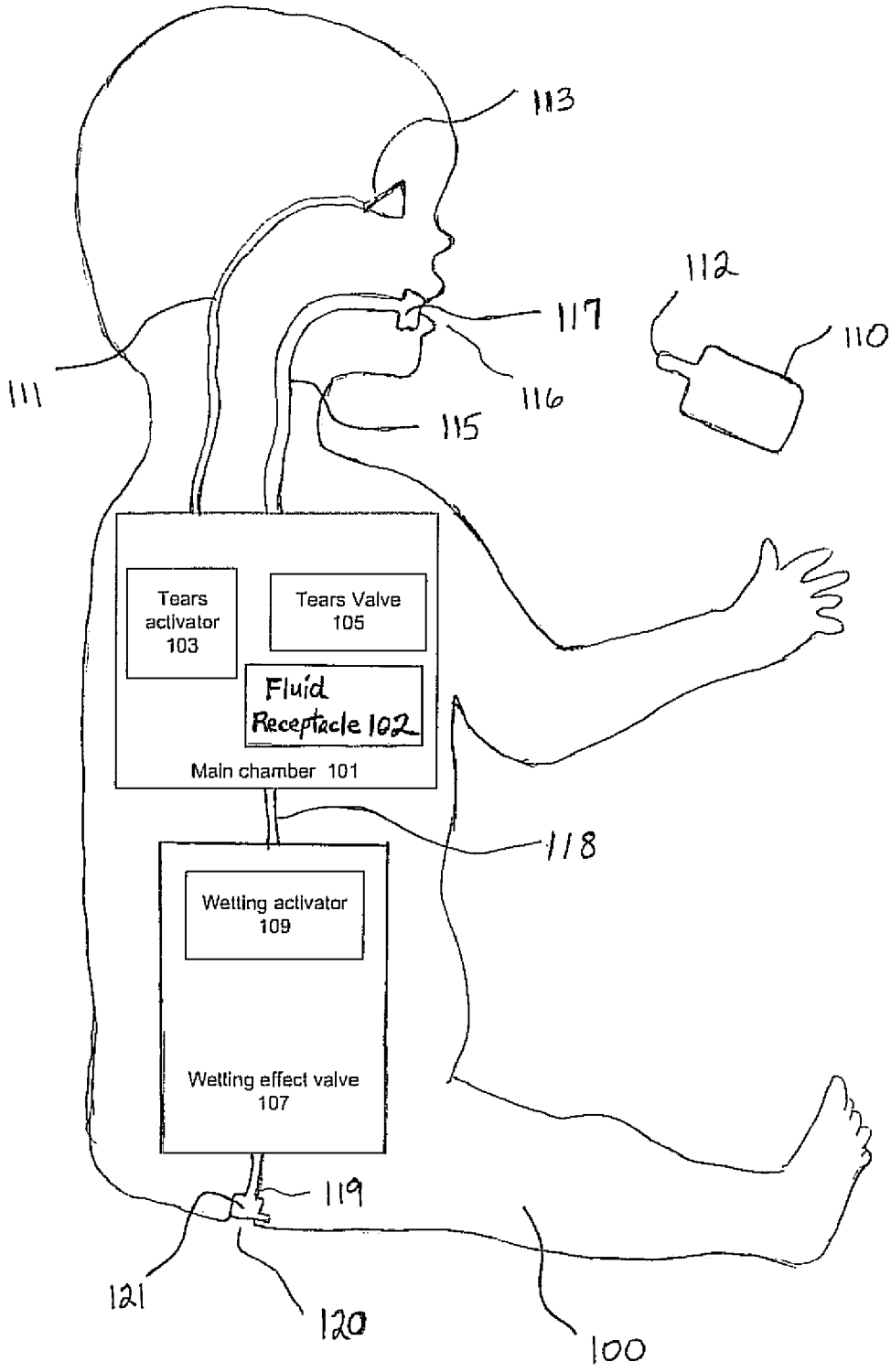
FIG. 1A is a schematic block diagram of exemplary general mechanical components of a combined tearing and wetting system embodied in a doll according to an aspect of the present invention.

FIG. 1A is a schematic block diagram of general mechanical components of a combined tearing and wetting system incorporated in a toy doll 100 and a feeding apparatus 110 according to an aspect of the present principles. The location of components as shown in FIG. 1 is for exemplary purposes only and does not constitute the absolute positioning of the components. The doll 100 includes a main chamber 101 functionally connected to a wetting effect valve 107 via a connection tube 118.

The main chamber 101 includes a tears activator 103, a tears valve 105 and a fluid storage receptacle 102 each functionally connected to one another. The wetting effect valve 107 is controlled by a wetting activator 109. An overflow tube 118 connects the receptacle 102 to the wetting effect valve 107. A wetting outlet tube 119 connects the wetting effect valve 107 to an outlet 121, which is passed through an aperture 120 of the doll 100. Preferably, the aperture 120 is provided in the 'diaper area' of the doll, so as to simulate urination when the wetting activator 109 is deployed.

The doll 100 includes a mouth aperture 116 at which a mouth valve 117 is provided. The mouth valve 117 is connected to the fluid receptacle 102 via an inlet tube 115 and is biased in a closed position, e.g., is kept closed via pressure exerted by, e.g., a spring to prevent fluid from being emitted from the mouth, in effect making the inlet tube 115 a one-way tube for permitting fluid intake into the receptacle 102 only.

A bottle 110 is provided having a tip member 112 shaped to be insertable within the mouth aperture 116 and configured to press on and open the mouth valve 117. A tears outlet tubing arrangement 111 is provided connecting the receptacle 102 to at least one tear duct in the doll's eyes 113. Preferably, at least one tear duct is provided in each of the doll's eyes to simulate crying when the tearing activator 103 is deployed. The tears outlet tubing arrangement 111 may comprise, e.g., one tube 111 split into two tubes 209 in the instance where fluid is desired to be provided to two eye ducts.

Figure 1B:
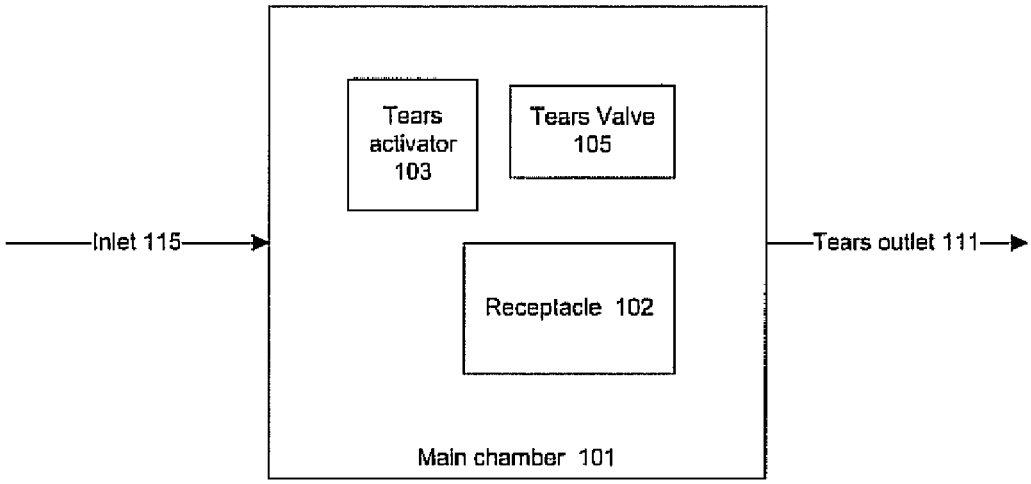
FIG. 1B is a schematic block diagram of exemplary components of a tearing system according to an aspect of the present invention.
Figure 1C:
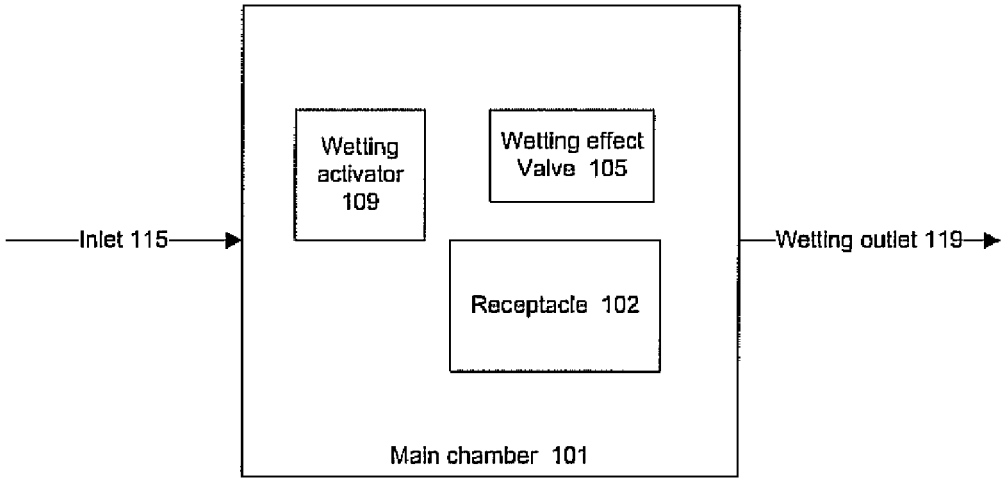
FIG. 1C is a schematic block diagram of exemplary components of a wetting system according to an aspect of the present invention.

FIG. 1B is a schematic block diagram of exemplary components of a tearing system only according to an aspect of the present invention. FIG. 1C is a schematic block diagram of exemplary components of a wetting system only according to an aspect of the present invention. It is to be noted that various alternate embodiments may be contemplated in which only a tearing system (e.g., as schematically shown in FIG. 1B) or only a wetting system (e.g., as schematically shown in FIG. 1C) is utilized. For example, a toy may be provided incorporating a tearing feature only, or a wetting feature only.

It is to be further noted that either of the tearing system, the wetting system or the combined tearing and wetting systems may be incorporated into any object in which such effects are desired, including but not limited to toy dolls and other toy objects. The tearing and/or wetting systems of the present invention may be incorporated into toys which may further include additional components and features, such as electronic components, circuitry, etc. for additionally providing sound effects, movement and other powered features. The tearing and/or wetting systems of the present invention may be adapted to be functionally operable and interactive with any such additional components and/or features.

Figure 2:
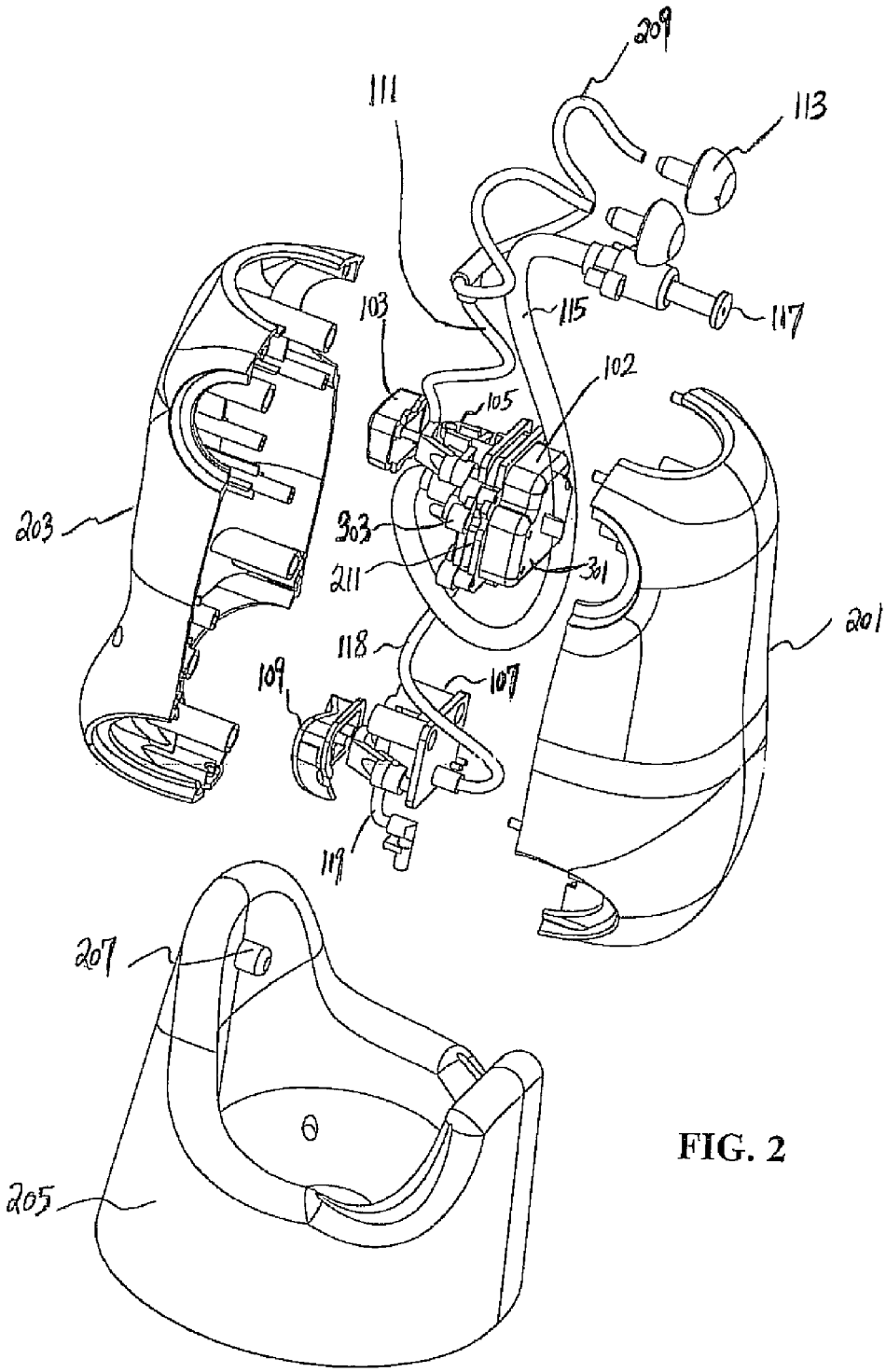
FIG. 2 is an exploded view of an exemplary configuration of mechanical and structural components of a tearing and wetting system enclosed in an internal casing for placement within a doll and a self-activating potty according to an aspect of the present invention.
Figure 4:
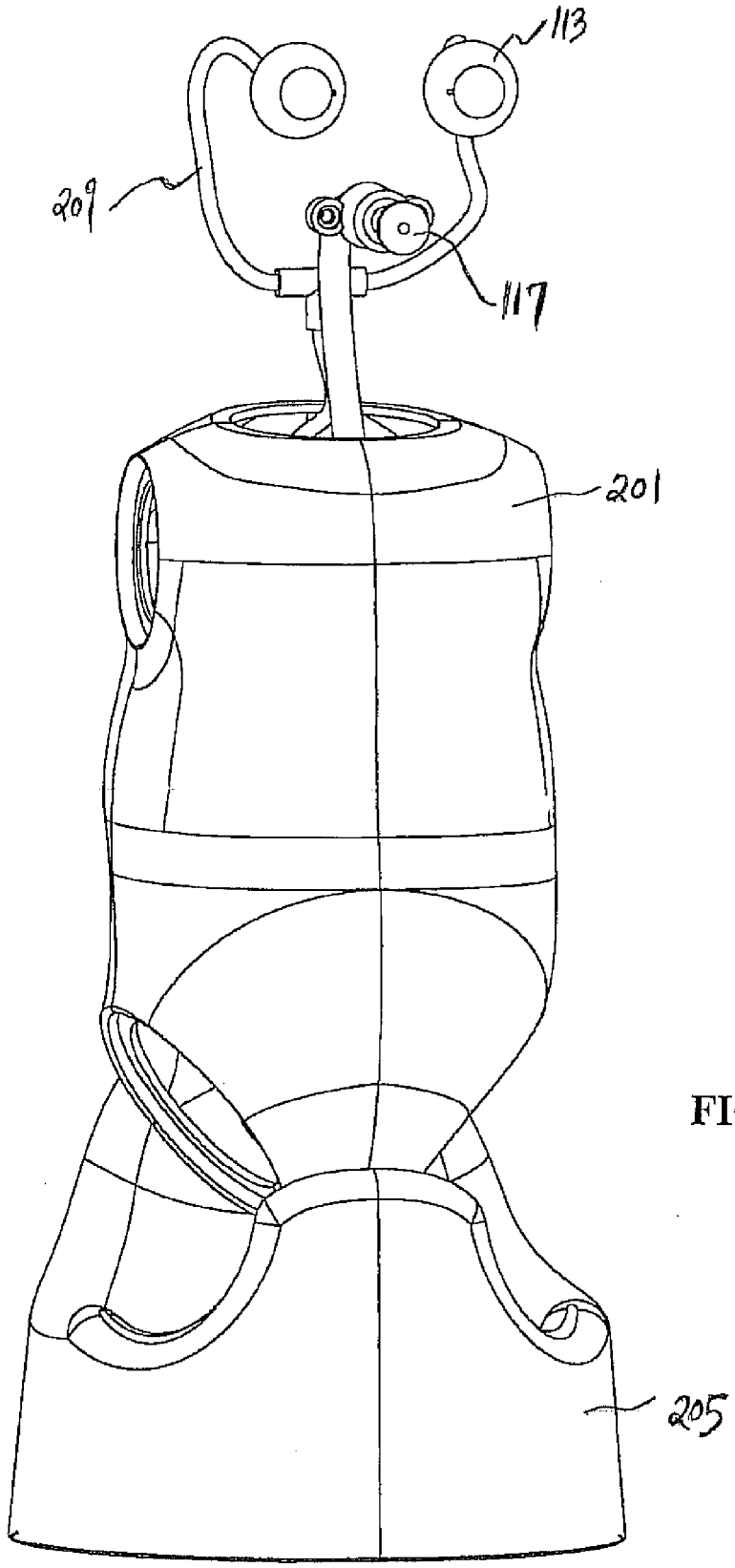
FIG. 4 is a front perspective view of an assembled internal casing as shown in FIG. 2 enclosing a tearing and wetting system according to an aspect of the present invention.

FIG. 2 is an exploded view of an exemplary configuration of mechanical and structural components of a tearing and wetting system enclosed in an internal casing for placement within a doll, as well as a self-activating potty 205 according to an aspect of the present invention. The internal casing comprises a front cover 201 and a back cover 203 fitted together. The internal casing is preferably insertable within a container 205 such as a potty 205 (which may also include a 'self-activating' feature such that when the doll 100 is seated within the potty 205 fluid from the doll is automatically caused to be emitted). FIG. 4 is a front perspective view of an exemplary assembled internal casing as shown in FIG. 2 enclosing a tearing and wetting system according to an aspect of the present invention.

The casing 201, 203 encloses the tearing and wetting system, which as previously shown schematically in FIG. 1, comprises a fluid receptacle 102 having a tears activator 103 (in FIG. 2, the tears activator 103 is represented by a button for pressing manually), and a tears valve 105.

An inlet tube 115 is connected to the receptacle 102 at a first end and includes a mouth valve 117 at a second end configured for controlling and allowing fluid intake. The mouth valve 117 is preferably biased (e.g., spring biased) to a 'closed' position (e.g., is forcibly pushed outwards to restrict fluid flow). The valve may be opened by pushing inwards on valve 117, thus enabling fluid to be input into the inlet tube 115. The inlet tube 115 is a one-way tube for fluid intake only into the receptacle 102, and permits fluid to be passed through via forceful injection there through (e.g., by squeezing a bottle of fluid having a tip member pressing to open the mouth valve 117).

According to one embodiment, a first outlet tube 111 forks into two eye tubes 209 for connecting the tears valve 105 to each eye 113 of the doll. The first outlet tube 111 comprises a one-way tube permitting fluid output only. For example, fluid is blocked from traveling through the first outlet tube 111 unless the tears valve 105 is opened.

An overflow tube 118 connects the receptacle 102 with the wetting effect valve 107. The overflow tube 118 preferably allows excess fluid in the receptacle 102 to flow freely out of the receptacle 102 to the wetting effect valve 107, at which point the flow of fluid is stopped until the wetting activator 109 is deployed, thus opening the wetting effect valve 107. The opening of the wetting effect valve 107 causes fluid held in the overflow tube 118 to be emitted through a second outlet tube 119. The second outlet tube 119 is typically placed at an aperture 120 located in a 'diaper area' of the doll 100, to emulate a wetting effect simulating urination when fluid is emitted from the tube 119.

According to one embodiment, a self-activating potty 205 may be provided configured to allow the doll 100 to be seated therein. The potty 205 may include a protrusion 207 situated within an internal surface thereof so as to align with and press on the wetting activator 109 when the doll is placed on the potty 205. Thus, when the doll 100 is seated on the potty 205, the protrusion 207 presses on the wetting activator 109 and fluid is automatically emitted from the second outlet tube 119.

Figure 3A:
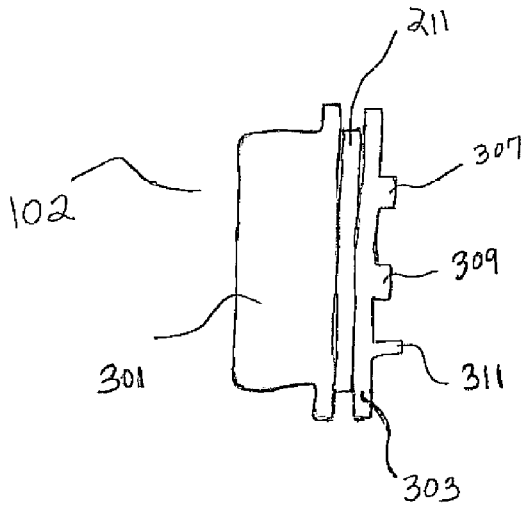
FIG. 3A is a side view of an exemplary fluid receptacle according to an aspect of the present invention.
Figure 3B:
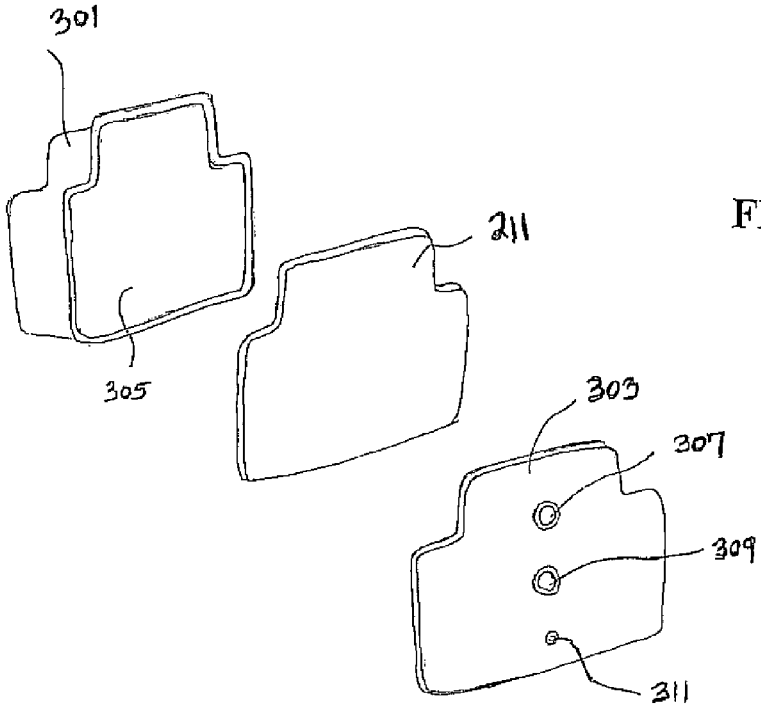
FIG. 3B is an exploded view of the exemplary fluid receptacle of FIG. 3A according to an aspect of the present invention.

FIG. 3A is a side view of an exemplary fluid receptacle 102 according to an aspect of the present invention. FIG. 3B is an exploded view of the exemplary fluid receptacle 102 of FIG. 3A according to an aspect of the present invention.

According to one embodiment, the receptacle 102 comprises a rigid housing member 301 having a hollow interior 305 and a rigid housing cover 303 which preferably comprises a flat sheet-like member and includes a plurality of apertures 307, 309, 311. The housing member 301 and cover 303 are preferably comprised of a hard, non-elastic and moldable material such as plastic, plastic composites, etc.

The plurality of apertures may preferably comprise at least three apertures, e.g., with two apertures being used to permit an outwards flow of fluid and one aperture permitting intake of fluid into the receptacle 102. For example, outlet apertures may include apertures 307 and 311 and an inlet aperture may comprise aperture 309, though any orientation and configuration of the apertures may be contemplated.

A resilient membrane 211 is provided for placement between the housing member 301 and cover 303. The resilient membrane 211 preferably comprises a thin, flat sheet of a pliant, flexible material, such as rubber, latex, etc. and is secured and compressed ('sandwiched') between the housing member 301 and cover 303 at its outer edges, when the housing member 301 and cover 303 are assembled.

When fluid is caused to enter the receptacle 102, it is input between the membrane 211 and cover 303. As the fluid is forcibly input into this area, the membrane 211 is caused to expand into the hollow area 305 of the housing cover 301. The resilient nature of the membrane 211 causes the fluid stored between it and the cover 303 to be stored under pressure, with the membrane 211 applying a force to its fluid contents as it seeks to contract to its original form. It is noted that the greater the amount of fluid that enters the receptacle, the more the membrane 211 expands and the greater the amount of pressure that is exerted on the fluid. A receptacle 102 'filled to capacity' would mean that fluid has stretched out the membrane 211 to or near its maximum stretch capacity (within the member 301 and cover 303) and that fluid fills both the inlet 115 and overflow tube 118 up to the point of valves 117 and 107.

A filled receptacle 102 causes fluid to seek expulsion through one of the outlet apertures (e.g., 307, 311). As discussed above, one of the outlet apertures may allow the fluid to pass through freely, depending on how much fluid is contained in the receptacle. The other outlet aperture may include a valve such as a tears valve 105 to enable manual control of fluid out of the receptacle 102.

For example, when receptacle 102 is filled (preferably to at least a sufficient capacity such that the fluid contained within is stored under some amount of pressure due to the membrane 211) the tears valve 105 may be opened, therefore allowing fluid from the receptacle 102 to flow through the first outlet tube 111. Fluid may be enabled to flow upwards, against the force of gravity, due to the pressure exerted on the stored fluid from the membrane 211. Thus, fluid may be caused to flow outwards from the receptacle 102 to the extent to which the pressure is sufficiently relieved.

Figure 3C:
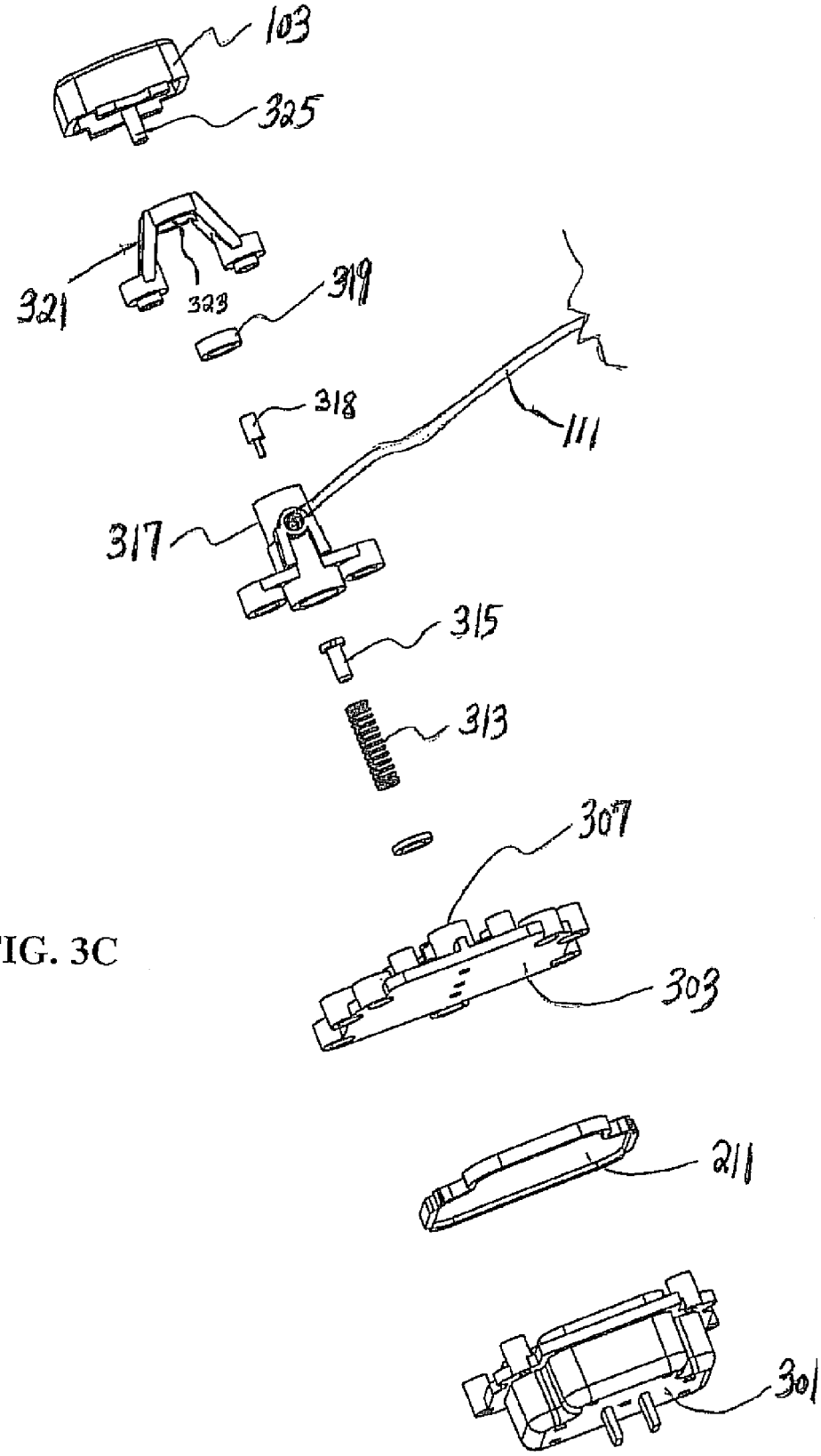
FIG. 3C is an exploded view of an exemplary fluid receptacle and a tears valve according to an aspect of the present invention.

FIG. 3C is an exploded view of an exemplary fluid receptacle and a tears valve 105 according to an aspect of the present invention. The receptacle 102 includes member 301, cover 303 and membrane 211 to which is attached a tears valve 105, which may be comprised of components 313, 315, 317, 318, 319, and 321, described further below.

Namely, a plug 315 is inserted atop a spring 313, which is itself inserted within aperture 307. A bottom bracket 317 is secured atop the plug 315, allowing the plug 315 to be insertably received within. The spring 313 biases the plug 315 in a 'closed' position, forming a seal between the plug 315 and the bottom bracket 317, and thus preventing fluid flow there through.

A pin 318 is inserted within an aperture of the bottom bracket 317, and a button 319 is placed atop the pin 318 and positioned so as to depress the pin 318 when pressed. The pin 318, when pressed, ultimately presses on plug 315. A top bracket 321 having an aperture 323 is fitted and secured atop the bottom bracket 317 with button 319 and pin 318 disposed there between. A tearing activator 103 having a protrusion 325 is fitted atop the top bracket 321, such that the protrusion 325 is received within aperture 323.

Upon activation of/pressing down upon the tearing activator 103, the protrusion 325 accordingly depresses the button 319, which causes pin 318 to push the plug 315 downwards, thus opening the seal and allowing fluid to pass from the receptacle 102 to the bottom bracket 317, where the fluid ultimately escapes through the tears outlet 111.

FIG. 4 is a front perspective view of an exemplary assembled internal casing as shown in FIG. 2 enclosing a tearing and wetting system according to an aspect of the present invention. The assembled internal casing is shown seated on the potty 205.

Figure 5:
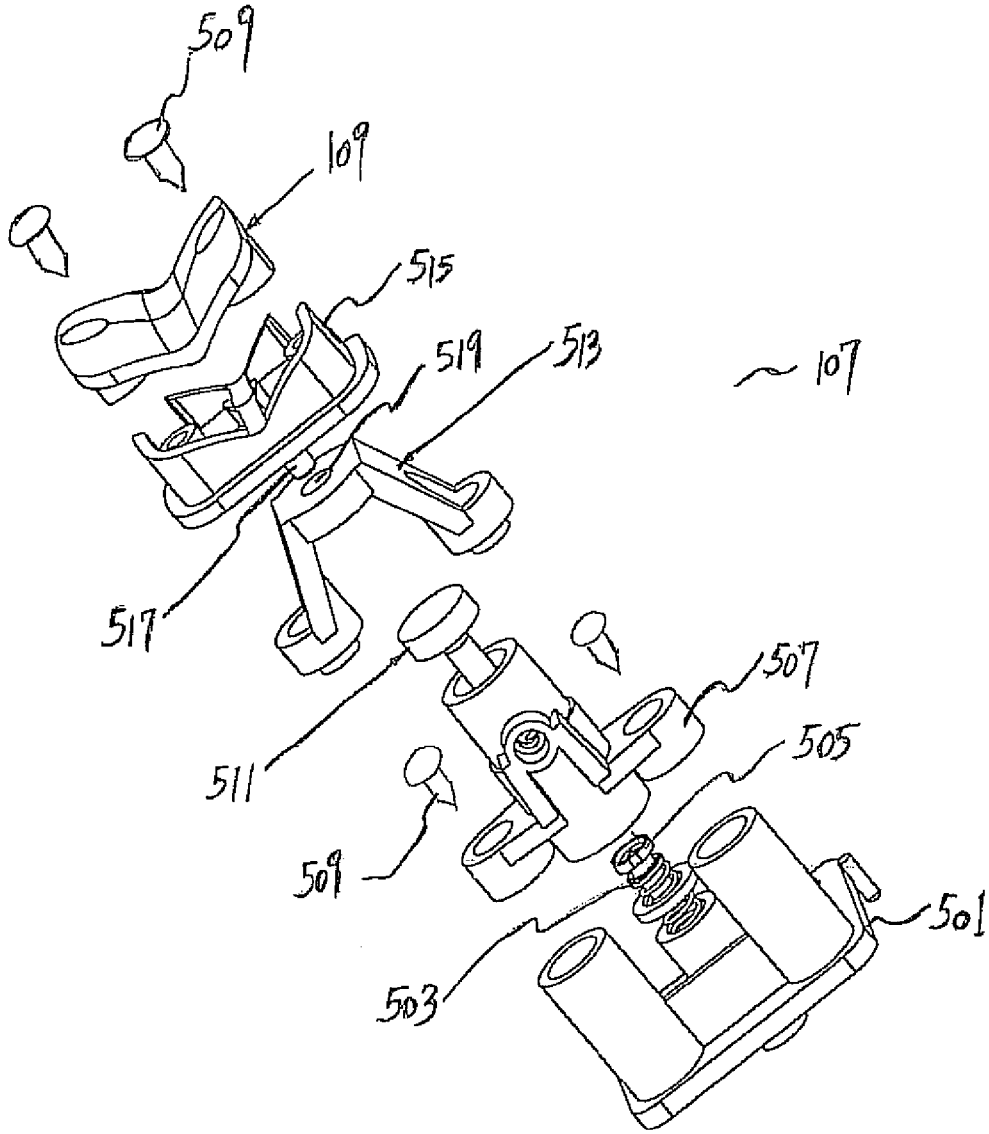
FIG. 5 is an exploded view of an exemplary wetting effect valve according to an aspect of the present invention.

FIG. 5 is an exploded view of an exemplary wetting effect valve 107 according to an aspect of the present invention. The wetting effect valve 107 is comprised of a bottom bracket 501, a center bracket 507 and a top bracket 513 stacked on one another. A spring 503 holding a plug 505 is inserted between the center bracket 507 and bottom bracket 501. The spring 503 keeps the plug 505 in an 'up' position, so as to provide a watertight seal and block the flow of fluid through the valve 107. A button 511 is provided between the top bracket 513 and center bracket 507, and is insertably fitted within an aperture in the center bracket 507. The button 511 may be depressed so as to make contact with and press downwards on the spring-loaded plug 505. Downwards pressure on the plug 505 opens the seal and enables fluid to flow through the valve 107.

A depressor 515 may be provided having a protrusion 517 which is insertable through an aperture 519 on the top bracket 513. A wetting activator 109 (here, in the form of a cover plate) sits atop the depressor 515. The wetting activator 109 when pressed, causes the protrusion 517 to press downwards on button 511, which in turn presses on the plug 505, thus opening the valve 107 and allowing fluid to pass through.

Figure 6:
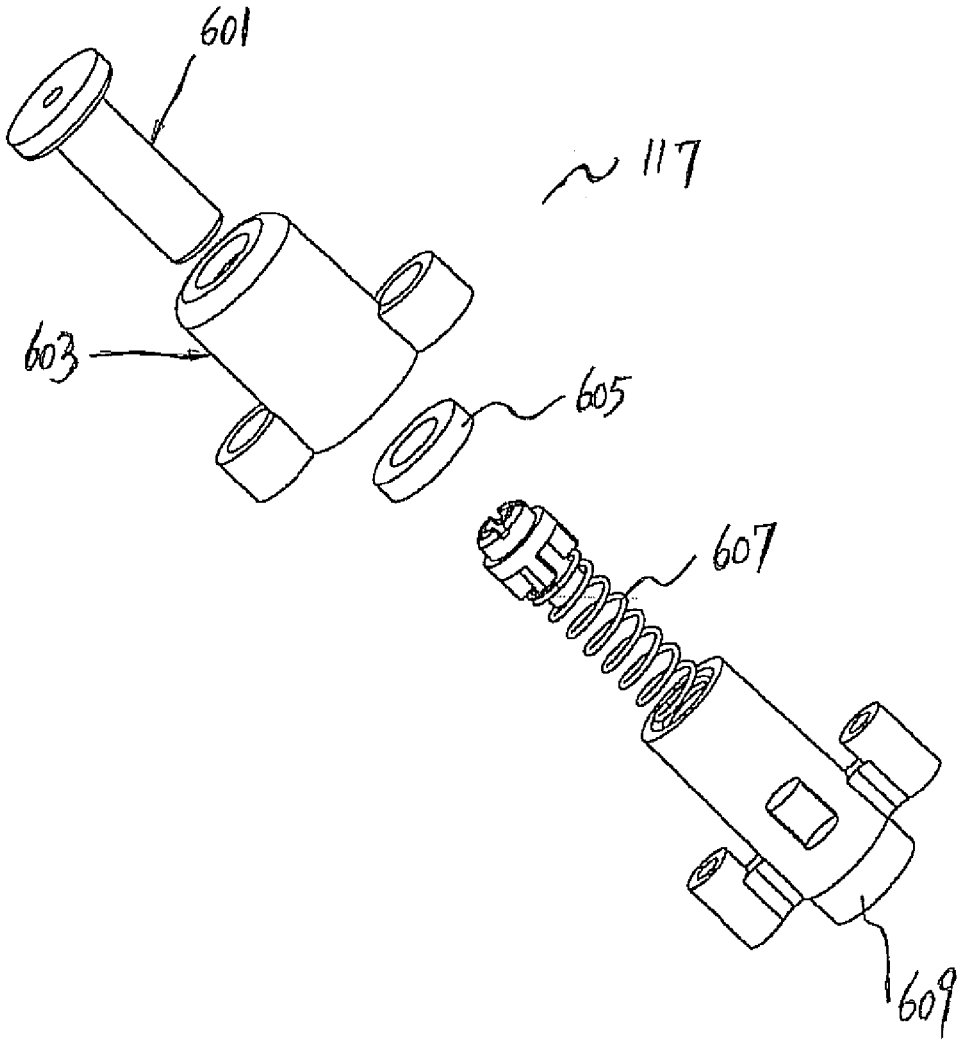
FIG. 6 is an exploded view of an exemplary intake valve according to an aspect of the present invention.

FIG. 6 is an exploded view of an exemplary intake valve 117 according to an aspect of the present invention. According to one embodiment, intake valve 117 is comprised of a mouth valve depressor 601 insertably fitted through an aperture of a top bracket 603 which is mounted onto a bottom bracket 609. A spring 607 is provided between the top bracket 603 and the bottom bracket 609 connected to a plug 605. The spring 607 is adapted to keep the plug 605 biased in a closed position (i.e., the plug 605 is kept pressed against the aperture of the top bracket 603) so as to maintain a seal and prevent fluid flow through the valve 117. The mouth valve depressor 601, when pressed, exerts a force on the plug 605, thus causing spring 607 to compress and opening the seal. Accordingly, fluid is permitted to pass through the valve 117.

Figure 7:
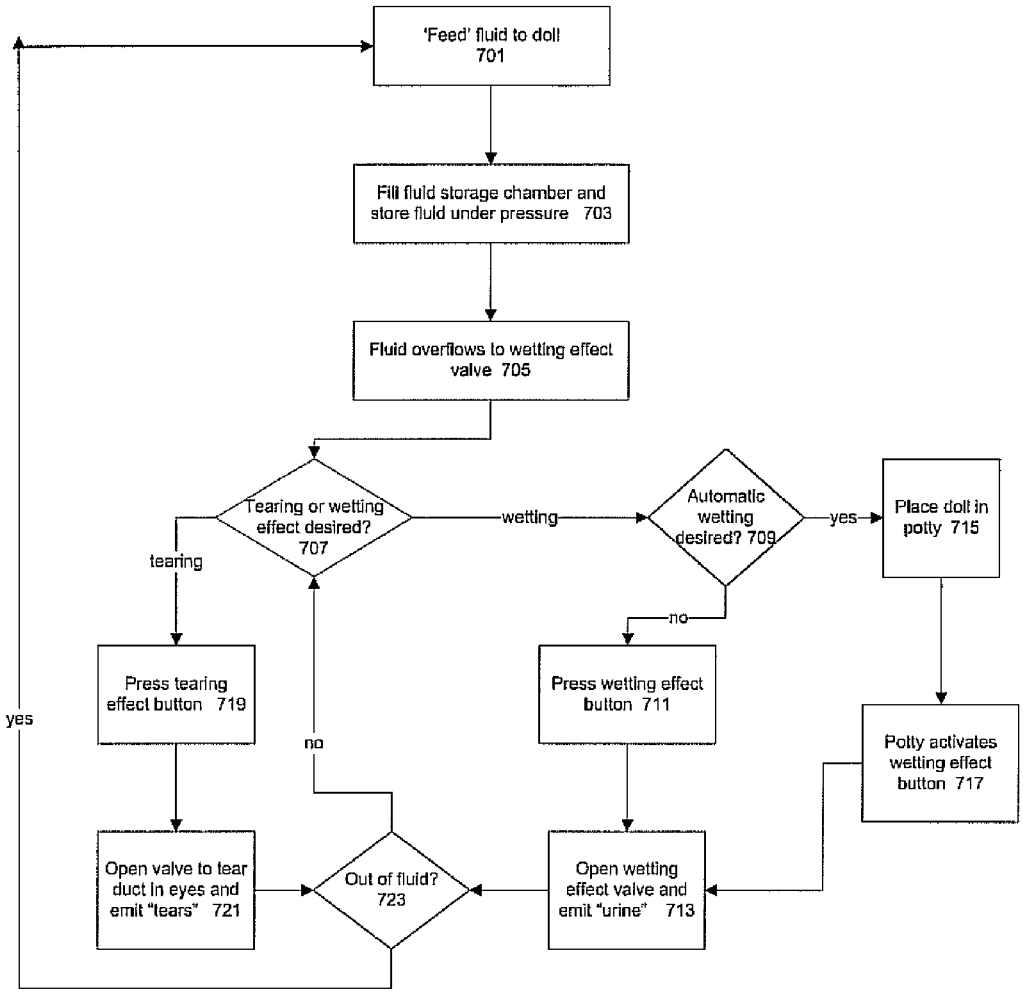
FIG. 7 is a flow chart of an exemplary method of operation of a toy doll according to an aspect of the present invention.

FIG. 7 is a flow chart of an exemplary method of operating a toy doll having a combined tearing and wetting effect system according to an aspect of the present invention. In step 701, the doll is fed, i.e., fluid is administered to the doll at its mouth opening via a bottle 110. For example, the tip 112 of the bottle 110 may be inserted into the mouth valve 117 and the bottle squeezed to forcibly push the fluid into the doll.

In step 703, the fluid receptacle of the doll is accordingly filled with fluid, the fluid flowing down the inlet tube 115 and expanding the resilient membrane 211 and causing the fluid to be stored under pressure. Some fluid is allowed to flow out of the receptacle 102 to the wetting effect valve (step 705). As described above, a receptacle 102 filled to capacity would mean that fluid has stretched out the membrane 211 to or near its maximum stretch capacity (within the member 301 and cover 303) and that fluid fills both the inlet 115 and overflow tube 118 up to the point of valves 117 and 107.

In decision step 707 it is ascertained whether a tearing or wetting effect is desired. If a wetting effect is desired, the method proceeds to decision step 709 where it is determined whether an automated wetting effect is desired. If yes, the doll is placed on a potty (step 715), which automatically activates a wetting effect button on the doll (step 717). This opens a wetting effect valve, thus causing fluid to be expelled from a bottom of the doll, simulating urination (step 713).

If after step 709 it is determined that an automatic wetting effect is not desired, the method proceeds to step 711 in which a user may manually press a wetting effect button on the doll, which accordingly opens the wetting effect valve (step 713).

If a tearing effect is desired, a user may manually press a tearing effect button (step 719) which opens a tears valve in the doll, thus releasing the pressurized fluid and enabling it to flow through an outlet tube 111 to tearing ducts in the doll's eyes to simulate a tearing/crying effect (step 721).

After either of steps 713 or 721, it is determined in step 723 whether the doll is out of fluid (i.e., whether the receptacle 102 is empty). If no, the method may proceed back to decision step 707. If the doll no longer holds any fluid, the method proceeds back to step 701 in which more fluid is administered to the doll to refill the receptacle 102.

Having described preferred embodiments for tearing and/or wetting effect systems (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A fluid intake and expulsion system for a toy doll comprising:
- a self-pressurized fluid receptacle, wherein the receptacle comprises:
  - a rigid housing member having an interior and a rigid housing cover including a plurality of apertures; and
  - a resilient member disposed between the housing member and the housing cover for providing an airtight chamber for storing fluid under pressure;
- an inlet valve, a first outlet valve and a second outlet valve operably connected to the receptacle;
- a first valve activator for manually opening the first outlet valve; and
- a second valve activator configured for manually opening the second outlet valve.

2. The system of claim 1, further comprising an inlet tube for connecting the inlet valve to the receptacle.

3. The system of claim 1, further comprising a first outlet tubing arrangement for connecting the first outlet valve to at least one eye duct in an eyeball.

4. The system of claim 1, further comprising a second outlet tube for connecting the second outlet valve to an outlet.

5. The system of claim 1, wherein the plurality of apertures comprises:
- a first aperture for connection to the inlet valve;
- a second aperture for connection to the first outlet valve; and
- a third aperture for connection to the second outlet valve.

6. The system of claim 1, further comprising a bottle having a tip member configured for opening the inlet valve to inject fluid into the receptacle.

7. The system of claim 1, wherein the inlet valve is biased outwardly to a closed position.

8. A toy doll comprising:
- a self-pressurized fluid receptacle disposed within the doll having a first outlet valve and a second outlet valve operably connected to the receptacle, wherein the receptacle comprises:
  - a rigid housing member having an interior and a rigid housing cover including a plurality of apertures; and
  - a resilient member disposed between the housing member and the housing cover for providing an airtight chamber for storing fluid under pressure between the resilient member and the housing cover;
- an inlet valve provided at a mouth opening in the doll and operably connected to the receptacle;
- a first valve activator button for manually opening the first outlet valve;
- a second valve activator button configured for manually opening the second outlet valve; and
- a bottle having a tip configured to be insertable into the mouth opening for opening the inlet valve.

9. The doll of claim 8, wherein the resilient member comprises a sheet of material configured to expand into the interior of the housing member when fluid is injected into the airtight chamber between the resilient member and the housing cover.

10. The doll of claim 8, wherein the plurality of apertures comprises:
- a first aperture for connection to the inlet valve;
- a second aperture for connection to the first outlet valve; and
- a third aperture for connection to the second outlet valve.

11. The doll of claim 8, further comprising an inlet tube for operably connecting the inlet valve to the receptacle.

12. The doll of claim 8, further comprising a first outlet tubing arrangement for connecting the first outlet valve to at least one eye duct in an eyeball of the doll.

13. The doll of claim 8, further comprising an aperture disposed in a diaper area of the doll and a second outlet tube for connecting the second outlet valve to an outlet located at the aperture.

14. The doll of claim 8, further comprising a potty container having a protrusion adapted to automatically activate the second valve activator button when the doll is placed on the potty.

15. A method for providing a tearing and wetting effect in a toy doll comprising the steps of:
- providing fluid into a self-pressurized receptacle inside the doll, wherein the receptacle comprises:
  - a rigid external casing comprising a housing member having an interior and a housing cover including a plurality of apertures; and
  - a resilient member disposed between the housing member and the housing cover for providing an airtight chamber for storing fluid under pressure between the resilient member and the housing cover, wherein the resilient member comprises a sheet of material configured to expand into the interior of the housing member when fluid is injected into the airtight chamber between the resilient member and the housing cover;
- providing overflow fluid to flow to a wetting effect valve;
- determining if at least one of a tearing effect and a wetting effect is desired; and
- activating at least one of a tearing activator or a wetting activator on the doll.

16. The method of claim 15, wherein the step of providing fluid further comprises:

pushing a bottle tip into a mouth opening of the doll to open a mouth valve; and injecting fluid into the mouth opening for filling the receptacle.

17. The method of claim 15, wherein the step of activating the tearing activator opens a tears valve for providing fluid to at least one eye duct in an eyeball.

18. The method of claim 15, wherein the step of activating the wetting activator opens a wetting effect valve for providing fluid to an outlet on the doll.

19. The method of claim 15, wherein if a wetting effect is desired, further comprising the step of determining if an automatic wetting effect is desired, wherein if yes, further comprising the step of placing the doll in a potty container for automatically activating the wetting activator.

20. A fluid intake and expulsion system for a toy doll comprising:

a self-pressurized fluid receptacle, wherein the fluid receptacle comprises:

a rigid housing member having an interior and a rigid housing cover including a plurality of apertures; and a resilient member disposed between the housing member and the housing cover for providing an airtight chamber for storing fluid under pressure between the resilient member and the housing cover;

an inlet valve, and at least one of a tears effect valve and a wetting effect valve operably connected to the receptacle; and at least one of a tears valve activator for manually opening the tears effect valve and a wetting activator configured for manually opening the wetting effect valve.

* * * * *